United States Patent [19]

Porco

[11] Patent Number: 4,550,734

[45] Date of Patent: Nov. 5, 1985

[54] BRASSIERE

[75] Inventor: Frank Porco, Bronx, N.Y.

[73] Assignee: Exquisite Form Industries, Inc., New York, N.Y.

[21] Appl. No.: 536,854

[22] Filed: Sep. 28, 1983

[51] Int. Cl.[4] ..... A41C 3/04

[52] U.S. Cl. ..... 128/460; 128/510

[58] Field of Search ..... 128/460, 461, 510

[56] References Cited

U.S. PATENT DOCUMENTS 2,928,396 3/1960 O'Dell ..... 128/460

3,145,714 8/1964 Brown ..... 128/460

FOREIGN PATENT DOCUMENTS 1004058 11/1951 France ..... 128/460

221990 6/1958 United Kingdom ..... 128/460

*Primary Examiner*—Doris L. Troutman

*Attorney, Agent, or Firm*—Lackenbach Siegel Marzullo Presta & Aronson

[57] ABSTRACT

A brassiere which is useful for nursing, maternity, and holding prosthetic devices is disclosed. The brassiere has a pair of openable cups. Each cup comprises at least one fold-over section adapted to open and close the cup and the fold-over section does not require any type of fastening means.

19 Claims, 27 Drawing Figures

FIG. 1
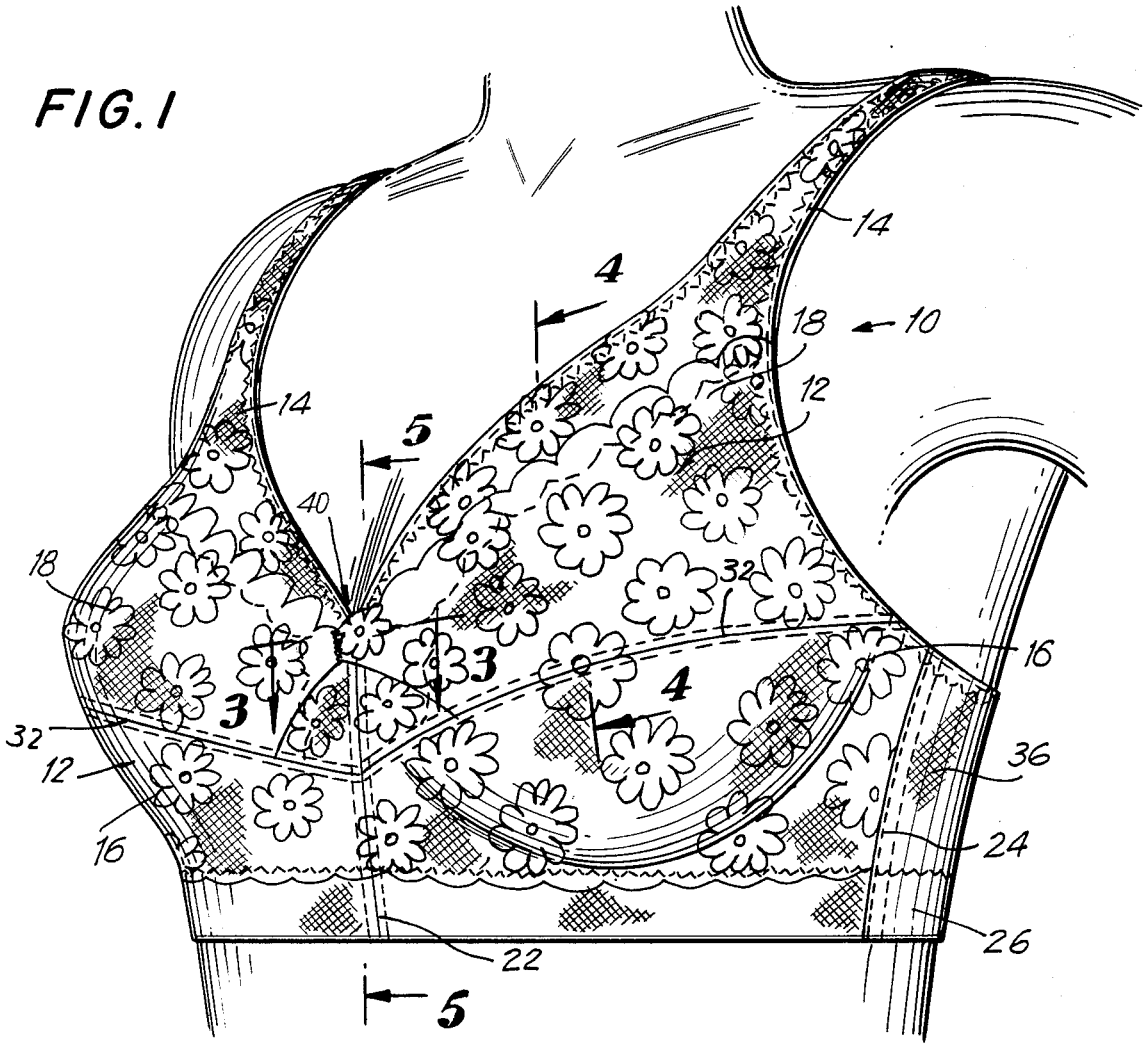
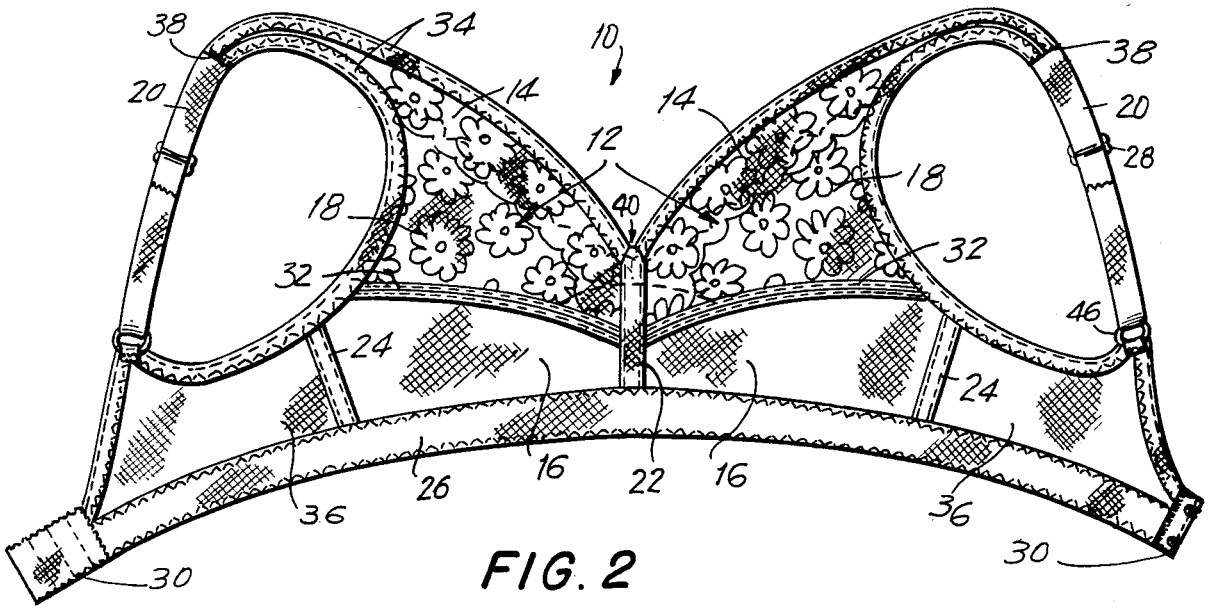
FIG. 2

FIG. 3
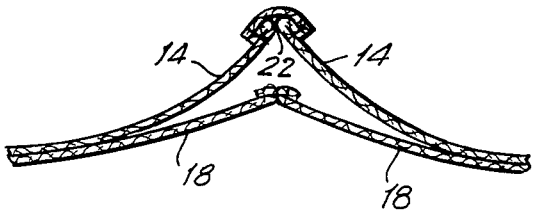
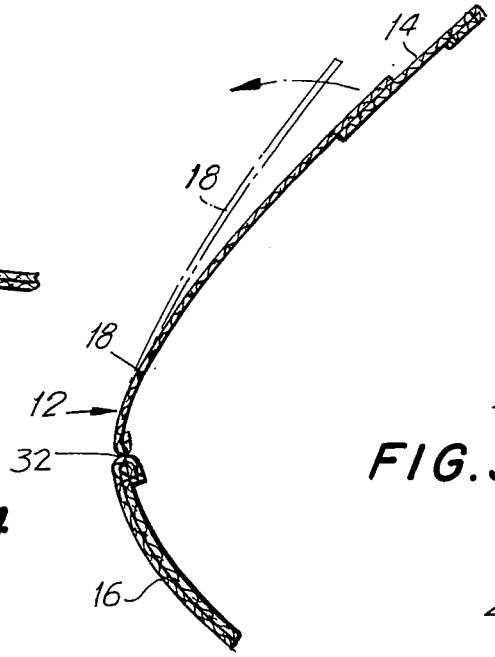
FIG. 4
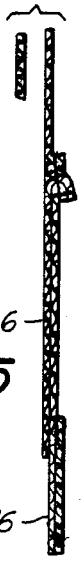
FIG. 5
FIG. 6
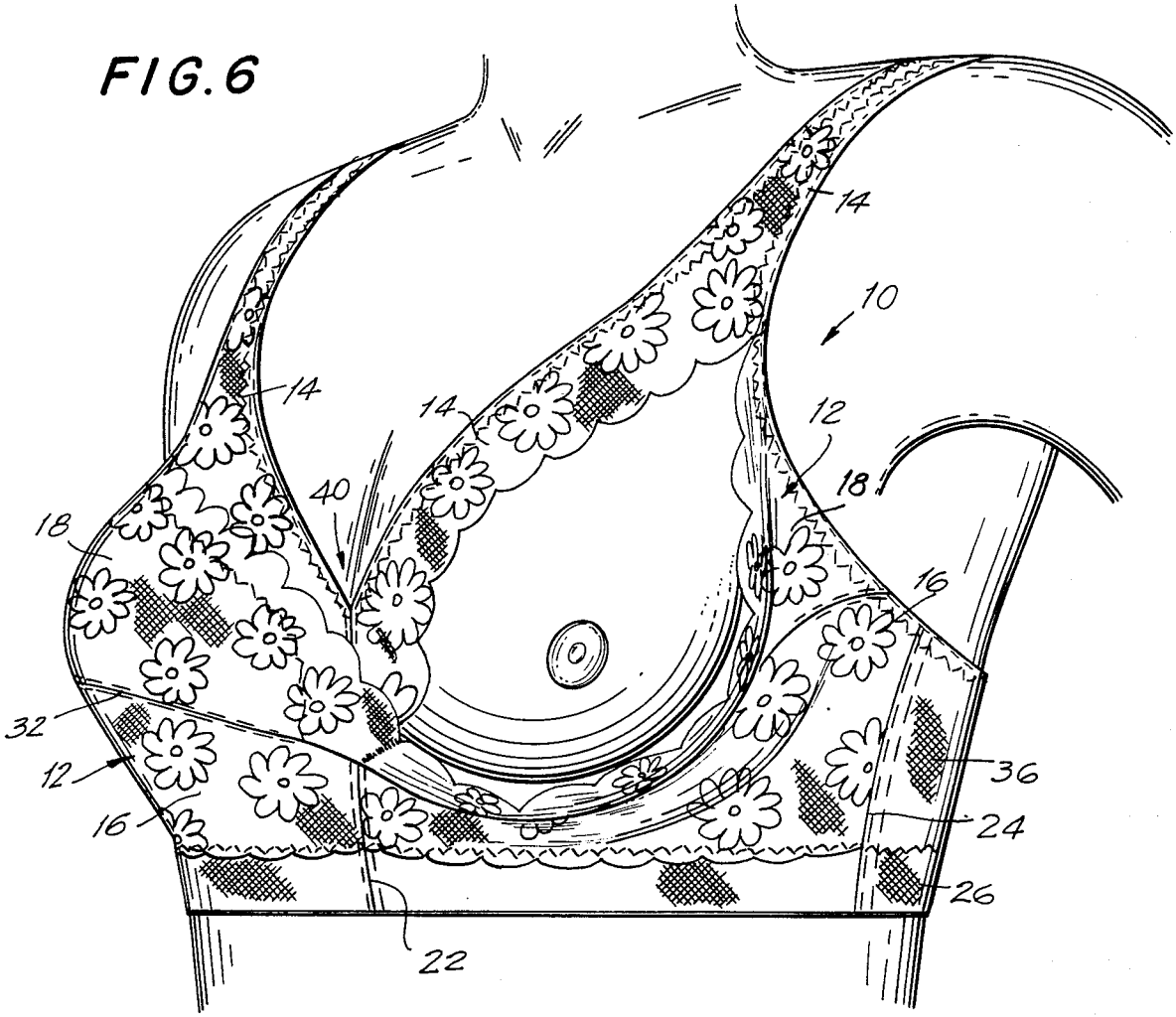

FIG. 7
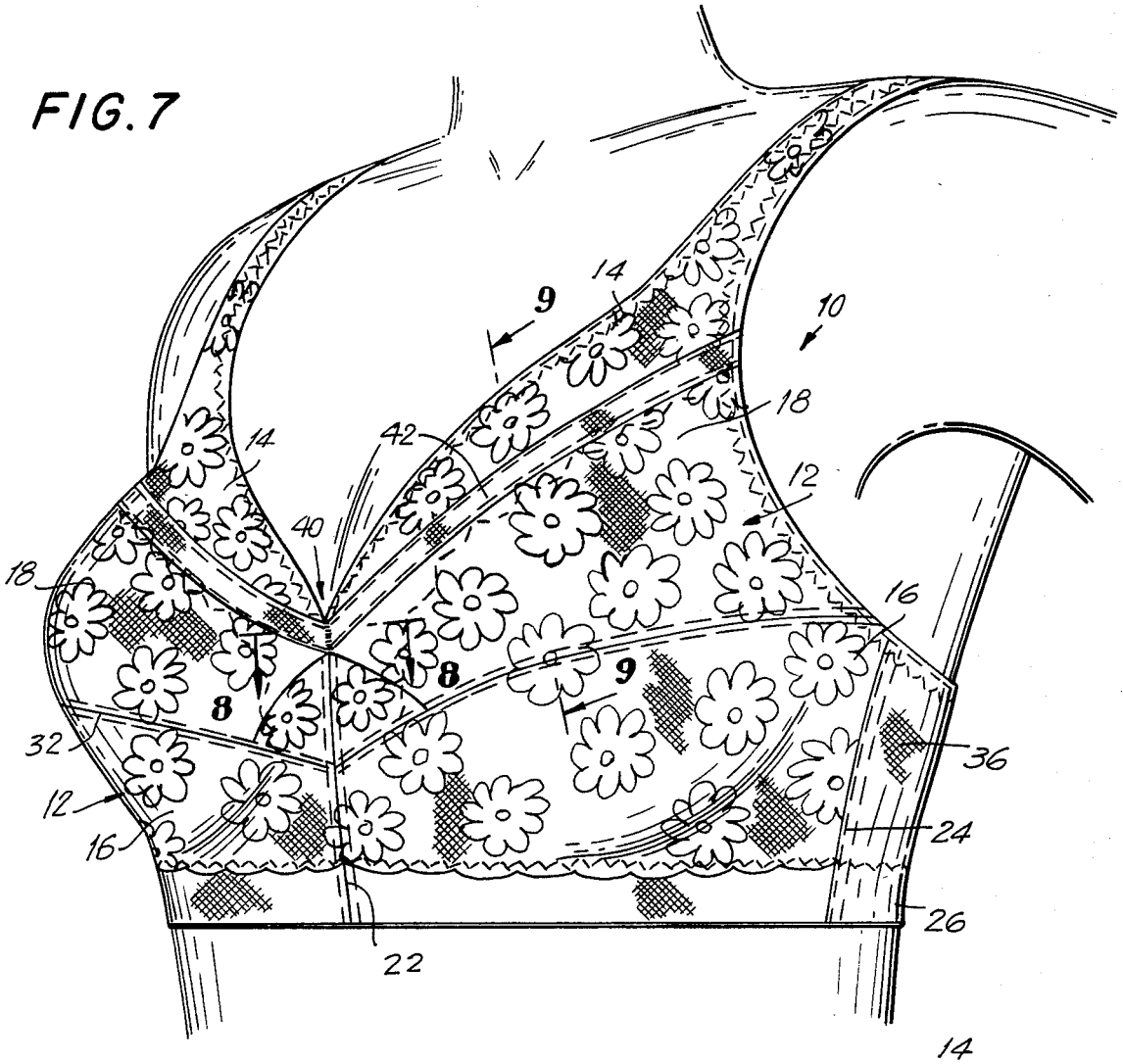
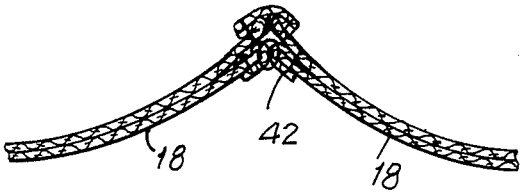
FIG. 8
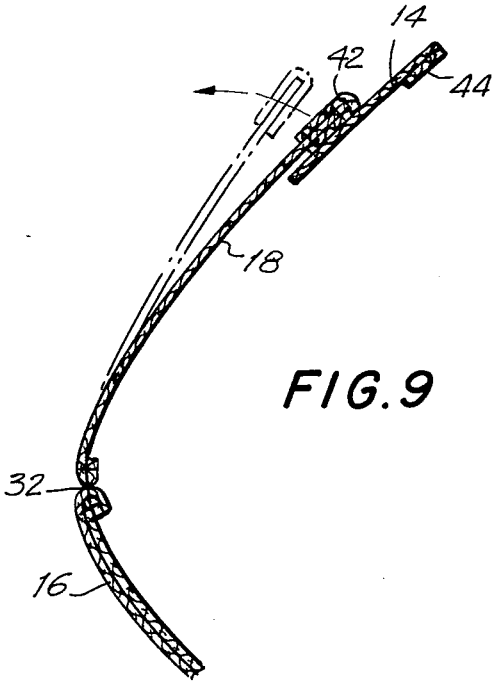
FIG. 9

FIG. 12
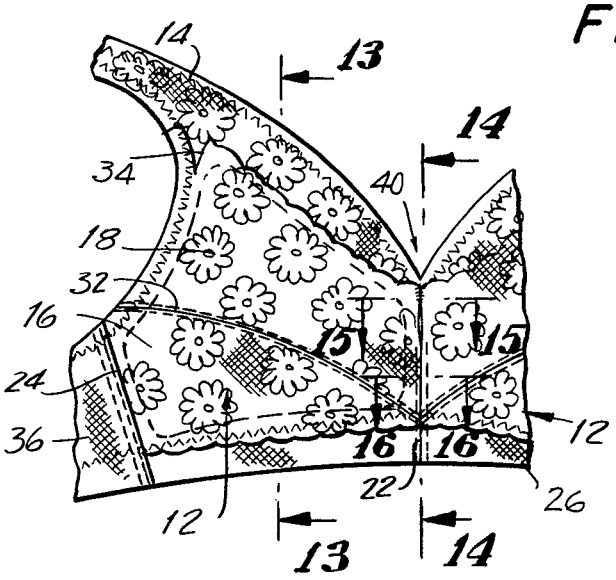
FIG. 13
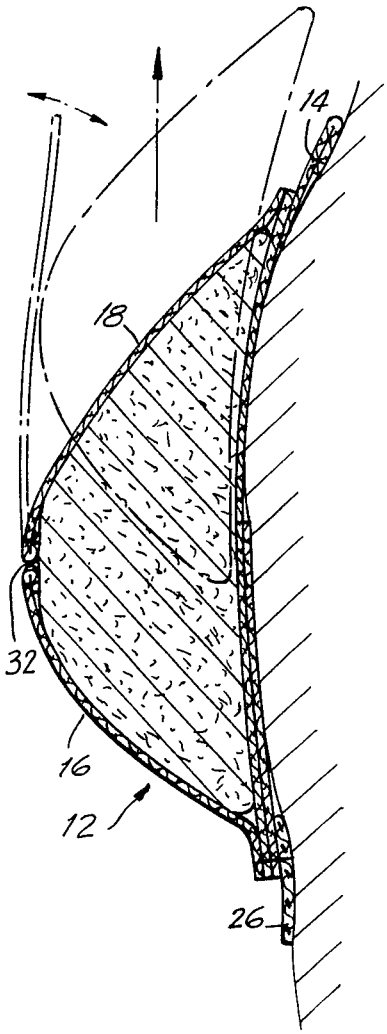
FIG. 14
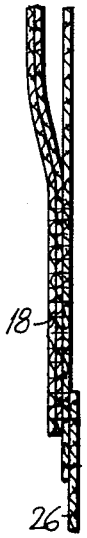
FIG. 15
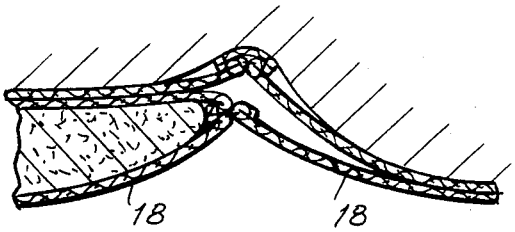
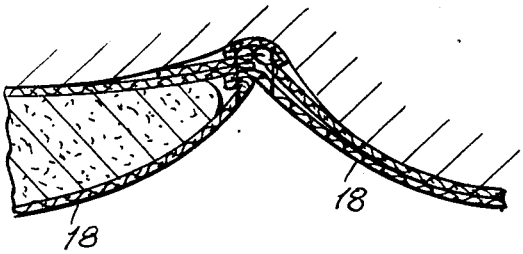
FIG. 16

FIG. 22
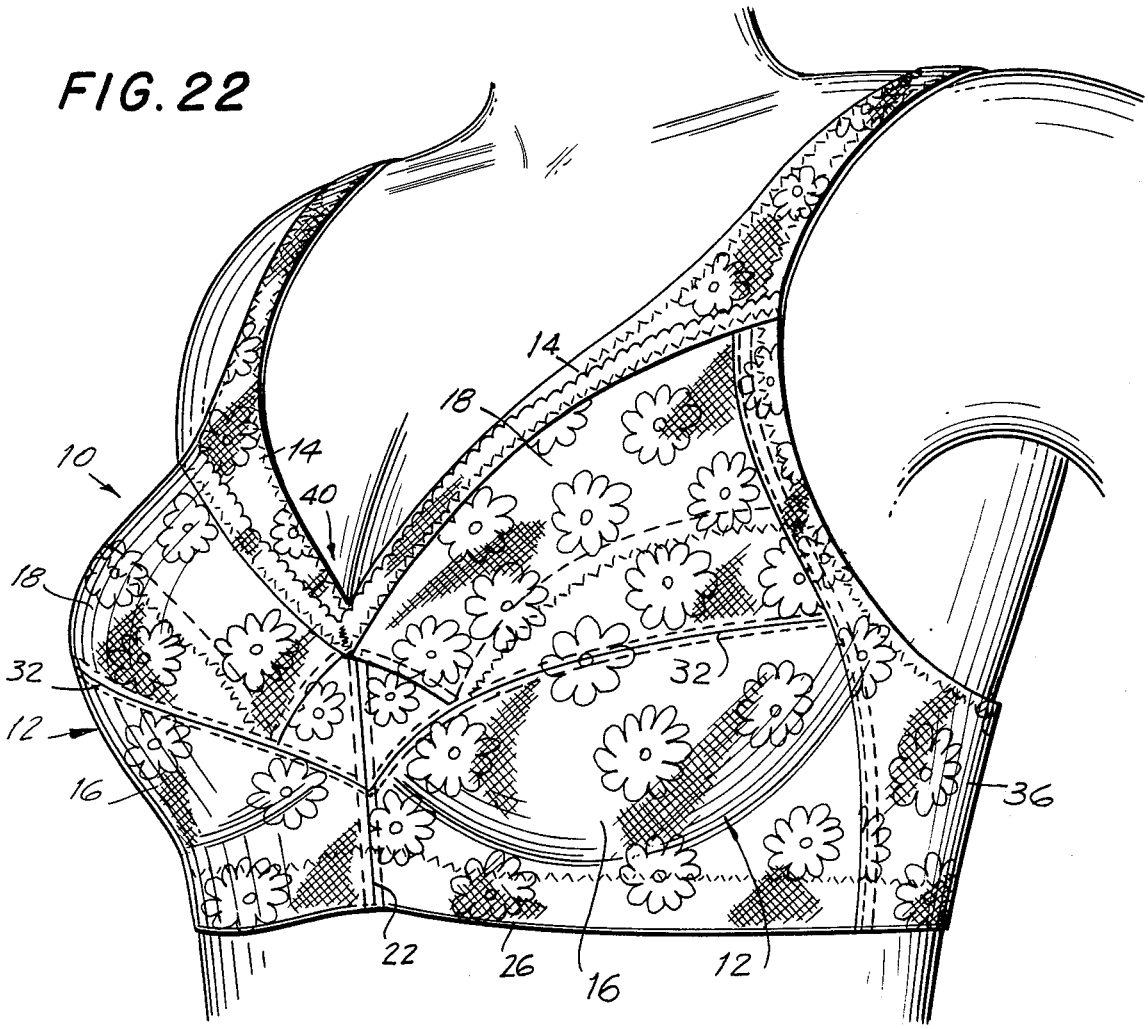
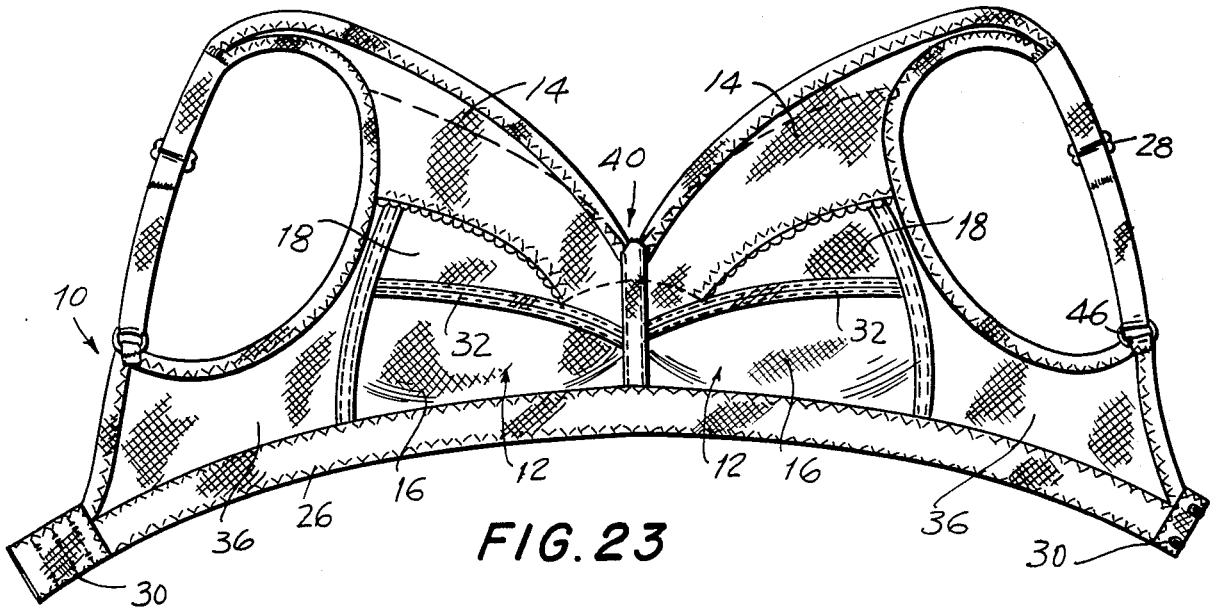
FIG. 23

BRASSIERE

FIELD OF THE INVENTION

This invention relates to brassieres, and more particularly, to brassieres which are primarily useful for nursing, and maternity, but which are also useful for holding prosthetic devices.

BACKGROUND OF THE INVENTION

Brassieres with openable bra cups have long been known in the prior art. These styles have always required some type of hooks, snaps, or other fastening means in order to open and close the bra cup. Such brassieres have been used for therapeutic, maternity, and nursing purposes.

U.S. Pat. No. 2,386,530 issued to Witkower on Oct. 9, 1945, discloses a nursing brassiere with "openable" breast pockets. The pockets are formed by an openable flap, which has a hook on its upper end. The hook engages an adjustable loop on a shoulder strap in order to close the pocket.

U.S. Pat. No. 2,679,048, issued to Alberts on May 25, 1954, shows a similar arrangement. An outer layer of fabric is provided with a hook at its upper end. The hook engages a complementary element at the upper end of an inner layer of fabric or on the lower portion of the shoulder strap in order to close the cup. The inner layer of fabric has a substantially elliptical aperture so that the cup is, in fact, open when the hook is not engaged.

U.S. Pat. No. 2,856, 935, issued to Croxall on Oct. 21, 1958, shows a maternity and nursing brassiere with adjustable and detachable cups. This is accomplished using a 3-point detachable suspension arrangement. Corresponding hook and eye members provide the means of detachment.

U.S. Pat. No. 3,409,017, issued to Ramsell on Nov. 5, 1968, shows another similar brassiere with "openable" cups. The cups are secured into a closed position by engaging a cup loop on each flap with an associated buckle on a shoulder strap.

Finally, U.S. Pat. No. 3,439,682, issued to Defru on Apr. 22, 1969, shows a therapeutic brassiere in which the cups are not permanently attached or stitched at any point, but are completely removable. The cups are then attached to the body of the brassiere by means of Velcro strips.

Brassieres having zippered cups are also known. Such zippers can be used to attach separate pieces of bra cup material to each other and to open and close the cup.

All of the prior art brassieres have the disadvantage of requiring hooks, snaps, or other fastening means in order to close the bra cup. When a fastening means is required, it is generally necessary for a woman to use two hands to fasten or unfasten the fastening means. This is an especial disadvantage for a woman who is nursing as only one hand is normally free of her baby and often she does not have a convenient place to rest her baby.

Furthermore, hooks, snaps, or other fastening means can create laundering problems. Such fastening means can easily snag other garments or become detached during laundering. These and other disadvantages of prior art brassieres are obviated by the brassiere of the present invention, the construction of which is described below.

OBJECTS OF THE INVENTION

It is, therefore, a primary object of the invention to provide a brassiere with openable cups which do not require any hooks, snaps, or other fastening means.

It is a further object of the invention to provide a brassiere with openable cups wherein the cups can be opened from the top, the bottom, or any side, and wherein the cups do not require any hooks, snaps, or other fastening means.

Other objects and advantages of the present invention will become apparent from the description of the invention.

SUMMARY OF THE INVENTION

The present invention is a brassiere having openable cups. The main inventive feature of the invention is that the cups do not require any fastening means, such as hooks or snaps.

Each bra cup of the brassiere is constructed with a "fold-over" section. The "fold-over" section is generally a four-sided section and may be attached to the remainder of the cup along at least two sides. The section may be folded so as to open the cup along the open-edge of the "fold-over" section. The construction of the brassiere of the invention can be understood more clearly with reference to the accompanying drawings.

DESCRIPTION OF THE DRAWINGS

FIG. 1 is a front perspective view of an embodiment of the brassiere of the invention, shown on the body of a wearer;

FIG. 2 is a plan view showing the inside of the brassiere of FIG. 1;

FIG. 3 is a cross-sectional view of the brassiere taken along section line 3—3 of FIG. 1;

FIG. 4 is a cross-sectional view of the brassiere taken along section line 4—4 of FIG. 1;

FIG. 5 is a cross-sectional view of the brassiere taken along section line 5—5 of FIG. 1;

FIG. 6 is a front perspective view of the brassiere of FIG. 1, shown on the body of a wearer with one of the bra cups shown in an open position;

FIG. 7 is a perspective view of an alternative embodiment of the brassiere of the invention;

FIG. 8 is a cross-sectional view of the brassiere taken along section line 8—8 of FIG. 7;

FIG. 9 is a cross-sectional view of the brassiere taken along section line 9—9 of FIG. 7;

FIG. 12 is a partial plan view of a further alternative embodiment of the brassiere of the invention;

FIG. 13 is a cross-sectional view of the brassiere taken along section line 13—13 of FIG. 12;

FIG. 14 is a cross-sectional view of the brassiere taken along section line 14—14 of FIG. 12;

FIG. 15 is a cross-sectional view of the brassiere taken along section line 15—15 of FIG. 12;

FIG. 16 is a cross-sectional view of the brassiere taken along section line 16—16 of FIG. 12;

FIG. 22 is a front perspective view of still a further alternative embodiment of the brassiere of the invention, shown on the body of a wearer;

FIG. 23 is a plan view of the embodiment of FIG. 22.

DETAILED DESCRIPTION OF THE INVENTION

Figure 10:
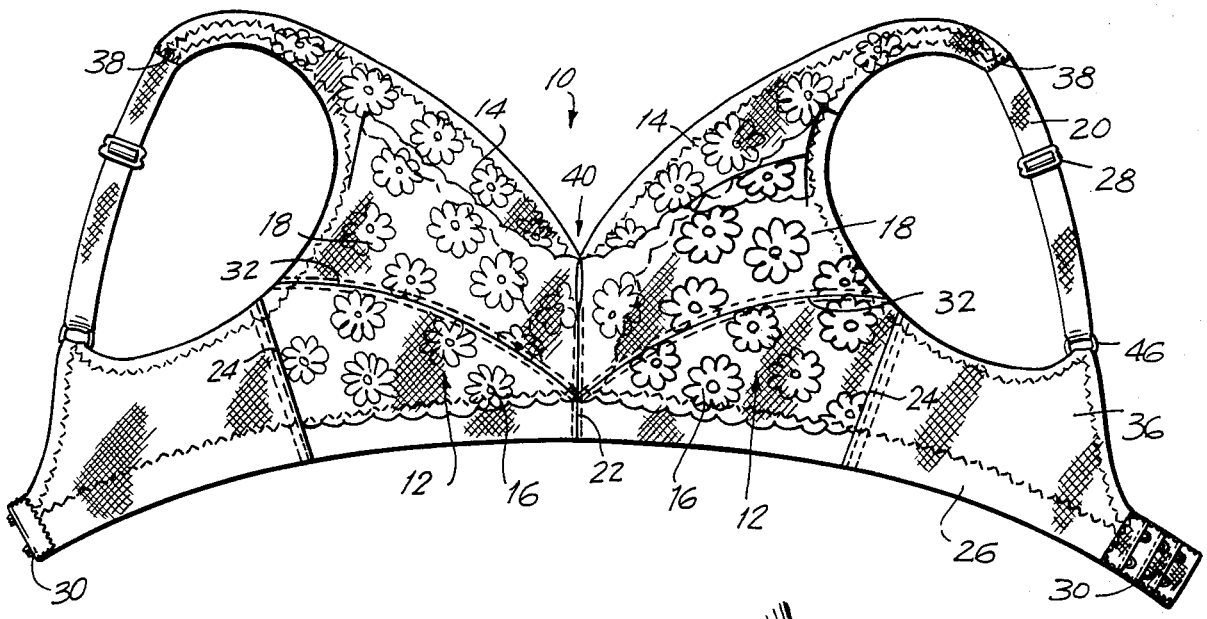
FIG. 10 is a plan view showing a still further alternative embodiment of the brassiere.

The present invention is a brassiere 10 having openable cups 12. The openable cups 12 do not require any fastening means, such as hooks or snaps. The brassiere is comfortable and easy to use. It can be conveniently worn during maternity, during nursing, or with a prosthetic device.

The brassiere 10 consists generally of a pair of bra cups 12 connected to each other along a center seam 22, two connecting bands 36 attached to an outside edge of each bra cup 12 along a side seam 24, and fastening means 30 for fastening cooperating ends of the two connecting bands 36 to each other. Shoulder straps 20 joining the bra cups 12 to the connecting bands 36 and an underbust band 26 secured along the lower edge of both bra cups 12 and both connecting bands 36 are optionally provided.

Each bra cup 12 is formed of at least two sections. These include an optional uppermost section 14, a "fold-over" section 18 and a lowermost section 16. In at least one alternative embodiment, "fold-over" section 18 and a lowermost section 16 are formed as one piece, as in a molded cup. For purposes of this specification, this embodiment is considered to comprise at least two sections.

It is to be understood that the term "fold-over", as used herein, is to be construed in the broadest possible sense of the word. Although the "fold-over" section of the cup may not actually fold so as to expose a breast, a section is considered to be a "fold-over" section if it can be stretched or deformed in any way so as to open the cup.

As shown in FIGS. 1–6, the uppermost section 14 is shaped like an elongated hexagon with three short sides and three long sides. The short sides occur at the center seam 22, the mid cup seam 32 and at shoulder strap connection 38.

The uppermost section 14 is formed of any suitable material such as cotton or lace. The material can be stretchable in at least one direction, and, in the preferred embodiment shown, is stretchable in the horizontal and diagonal directions, but is less stretchable in a vertical direction.

This section is considered to be optional because, although the basic elastic frame structure of the section is necessary to give the cup 10 the proper shape and support, it is not necessary to provide material on the frame structure.

The fold-over section 18 is generally quadrilateral in shape. Again, it may be formed of any suitable material such as cotton or lace. It is preferably capable of omnidirectional stretch.

The lowermost section 16 is generally pentagonal in shape. Once again, it may be formed of any suitable material such as cotton or lace or, even more preferably, lace with a suitable backing layer, such as a cotton backing layer, or a single ply-material, such as polycotton and Spandex TM. The lowermost section is also preferably stretchable in all directions, but not as stretchable as intermediate or "fold-over" section 18.

Fold-over section 18 is connected to lowermost section 16 at mid cup seam 32. Uppermost section 14 is also connected to lowermost section 16 along a small portion of mid cup seam 32 near center seam 22. The two cups 12 are joined to each other along center seam 22 which takes in material from lowermost section 16 and uppermost section 14. The two fold-over sections 18 are then joined to each other at a center point 40.

In use, fold-over section 18 can be folded down in order to expose a nipple, for example, for nursing as shown in FIG. 6. This simple arrangement has the advantage that the section 18 can easily be folded down with one hand and a baby or some other object can be held in the other hand. Although the bra 10 is shown with only one cup open, it is to be understood that both cups 12 can be opened, either at different times or at the same time.

In an alternative embodiment, shown in FIGS. 7, 8, and 9, the center point 40 at which fold-over section 18 of the cup 12 are joined to each other is fastened down to center seam 22. This embodiment also allows the fold-over section 18 of the cups 12 to open but the opening is more restricted in that there is less flexibility as compared to the embodiment of FIGS. 1 to 6. In this embodiment, it may be desirable to provide an elastic 42 along the top edge of fold-over section 18 of the bra cup 12. If an elastic 42 is provided, it may also be desirable to provide a binding material 44 along the outer edge as shown more clearly in FIG. 9.

Figure 11:
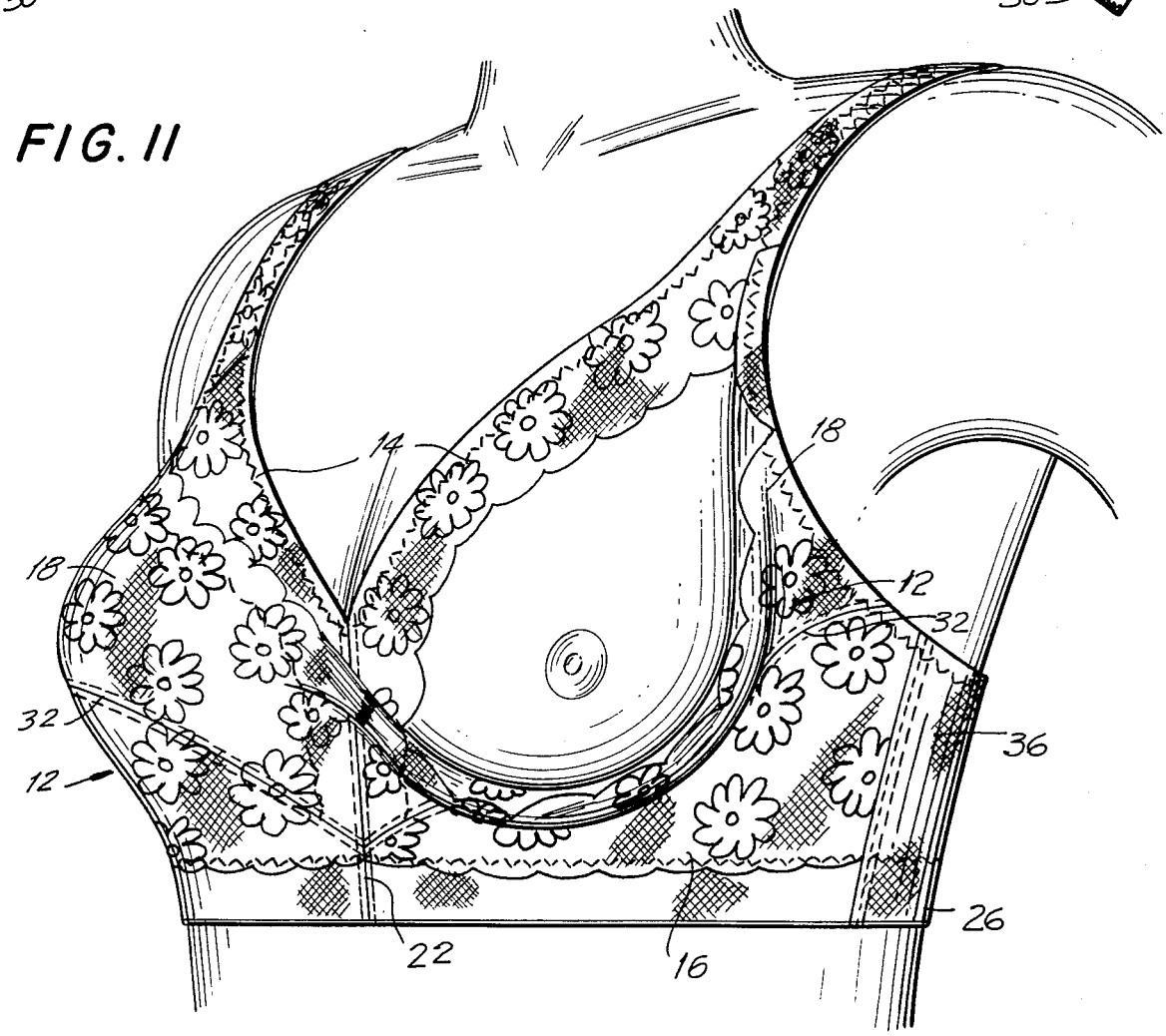
FIG. 11 is a front perspective view of the brassiere of FIG. 10, shown on the body of a wearer with one of the bra cups shown in an open position.
Figure 10A:
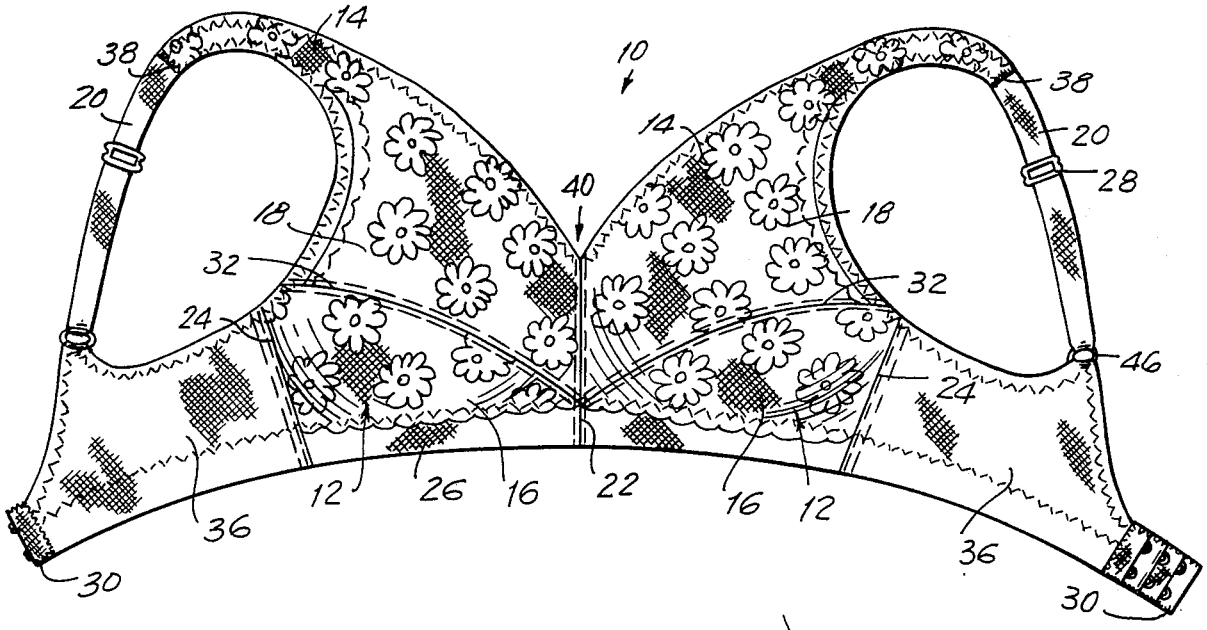
FIG. 10A is a plan view showing yet a further alternative embodiment of the brassiere.
Figure 10B:
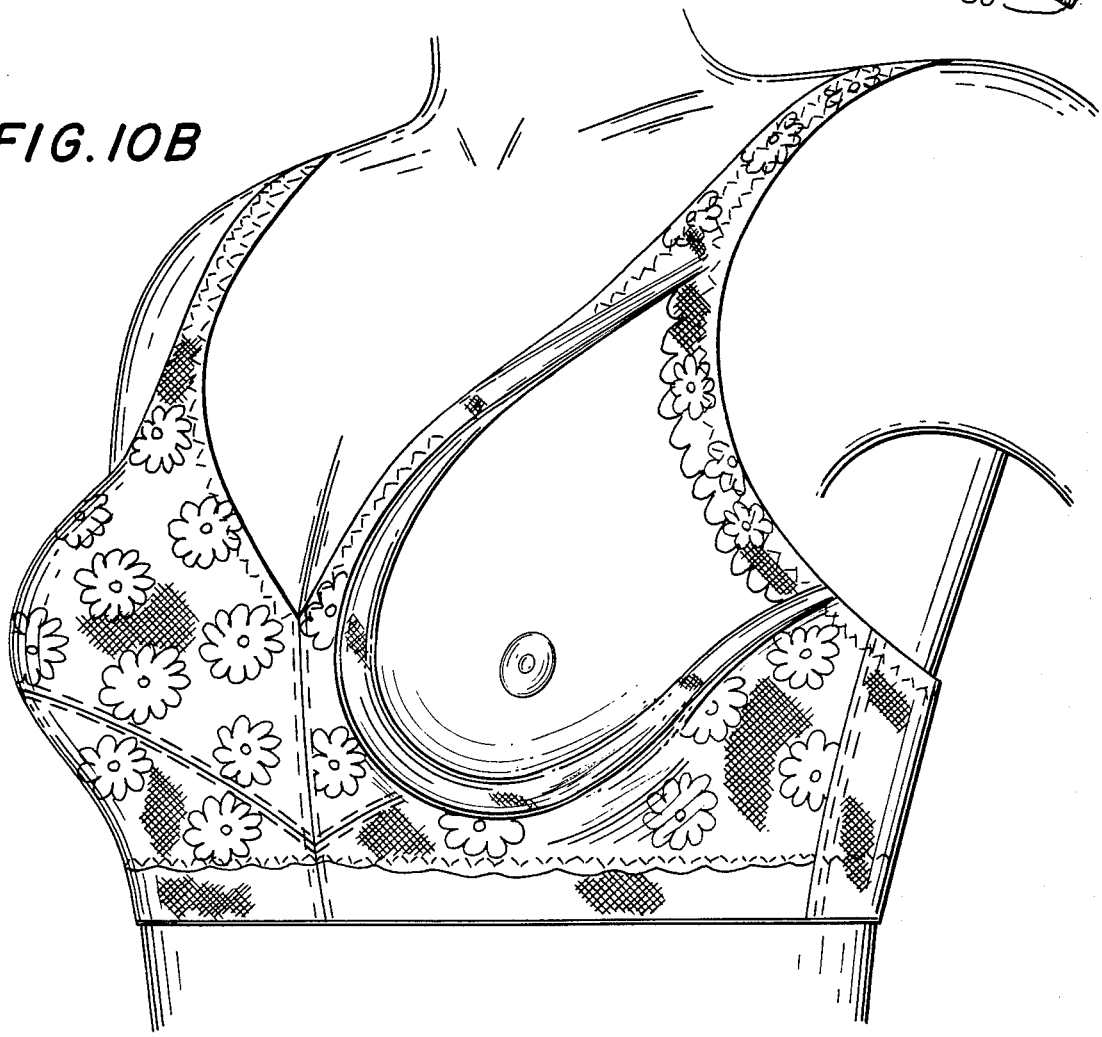
FIG. 10B is a front perspective view of yet another embodiment of the invention, shown on the body of a wearer, with one of the bra cups shown in an open position.
Figure 11A:
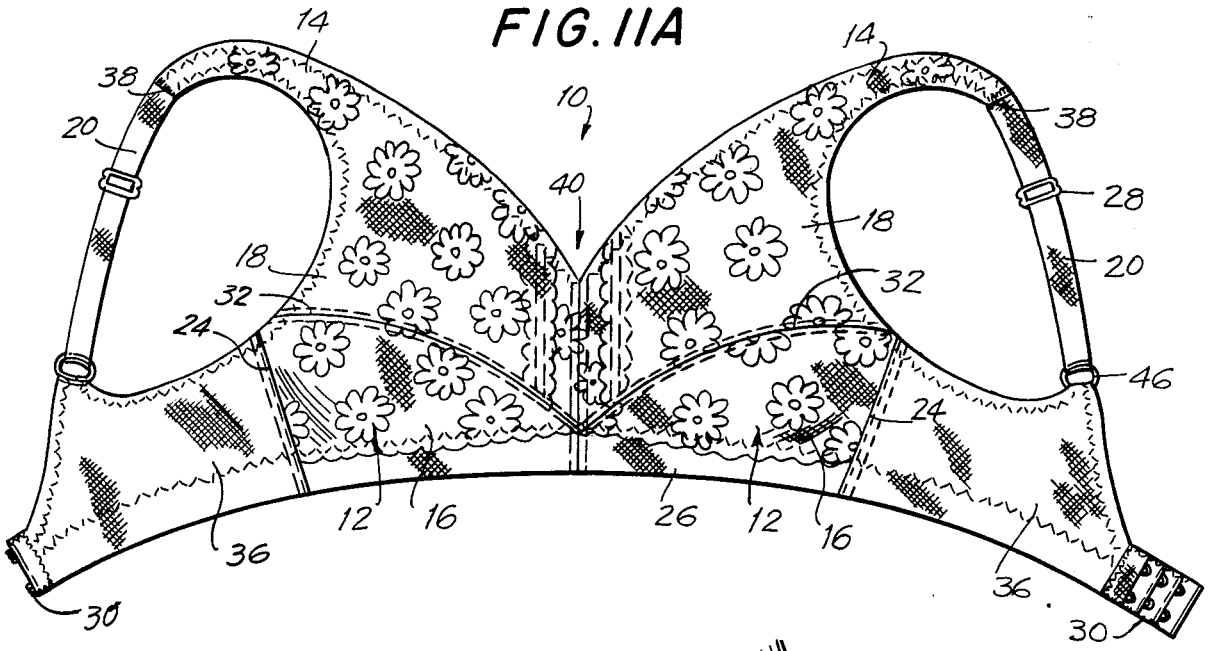
FIG. 11A is a plan view showing still a further alternative embodiment of the brassiere of the invention.
Figure 11B:
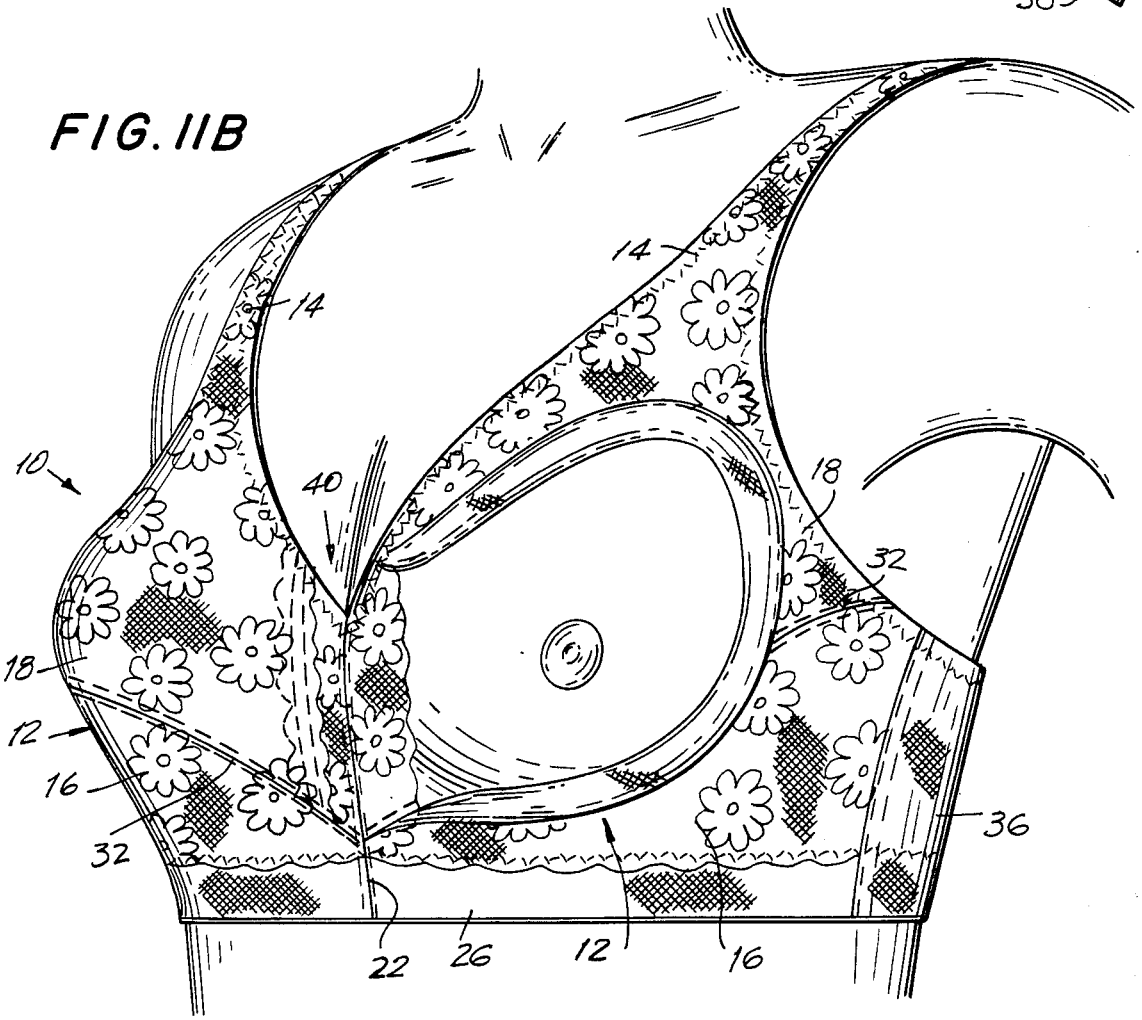
FIG. 11B is a front perspective view of yet another embodiment of the brassiere of the invention, shown on the body of a wearer, with one of the bra cups shown in an open position.
Figure 17:
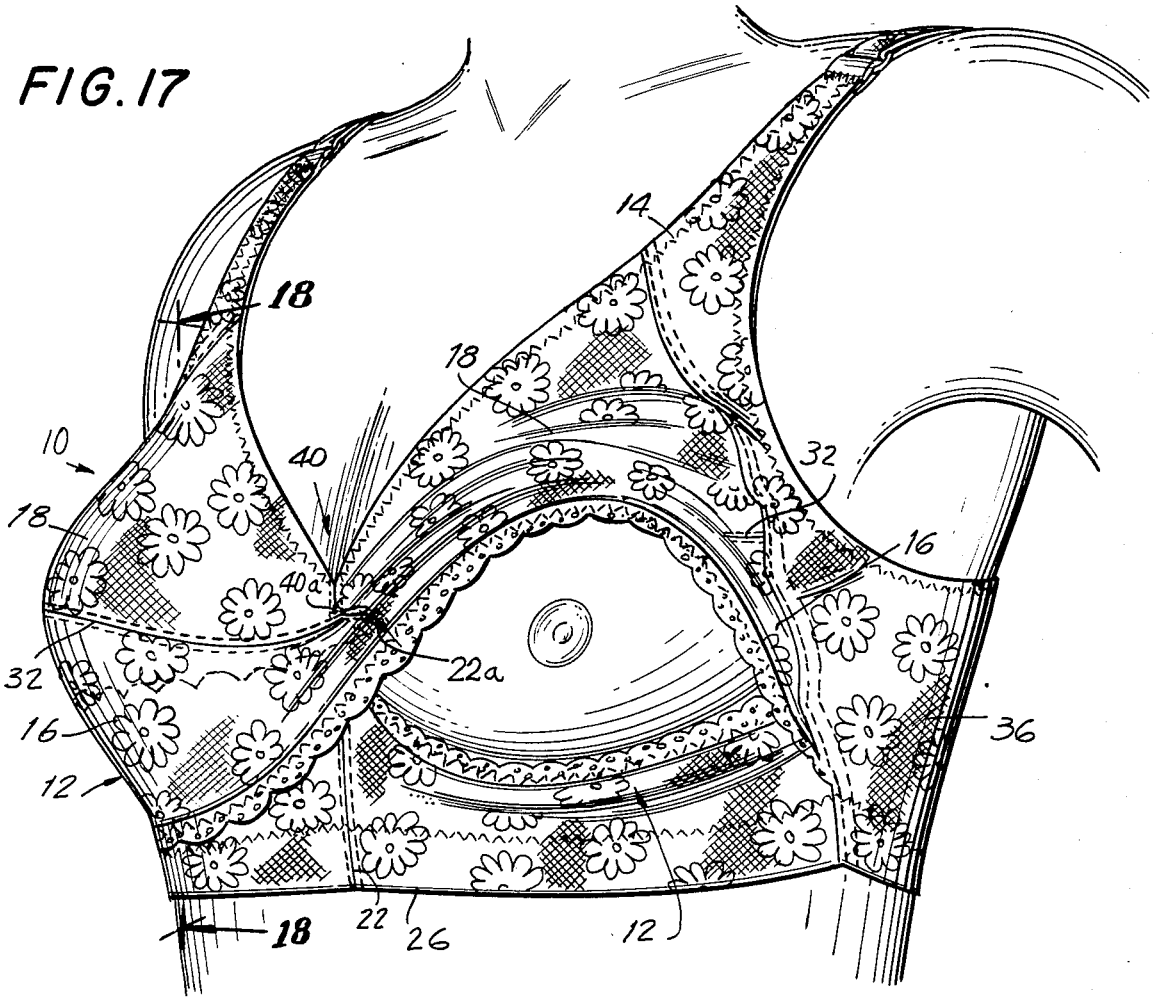
FIG. 17 is a perspective view of a still further alternative embodiment of the brassiere of the invention.
Figure 18:
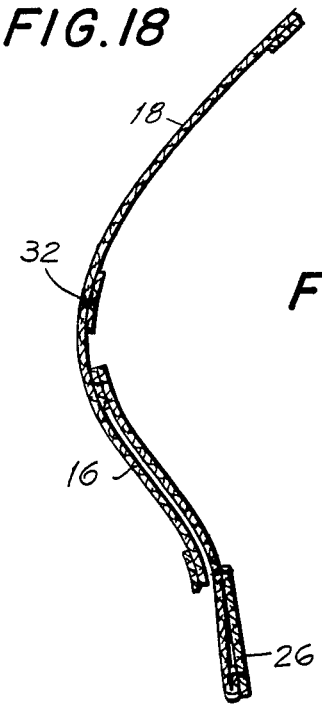
FIG. 18 is a cross-sectional view of the brassiere taken along section line 18—18 of FIG. 17.
Figure 20:
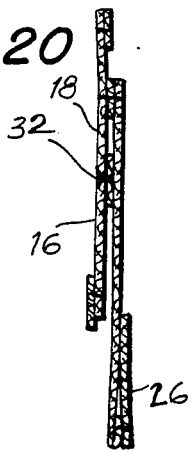
FIG. 20 is a cross-sectional view of the brassiere taken along section line 20—20 of FIG. 19.
Figure 19:
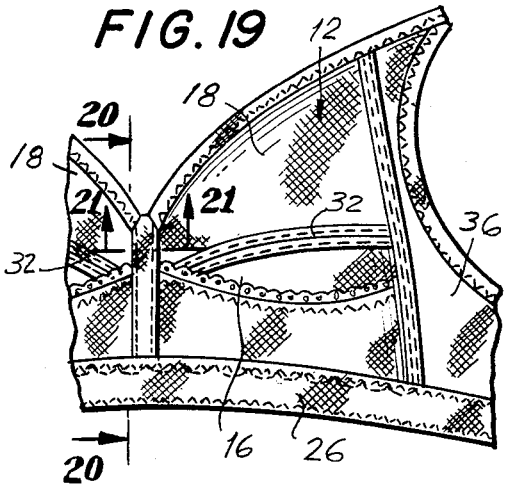
FIG. 19 is a partial plan view of the inside of the brassiere of FIG. 17.
Figure 21:
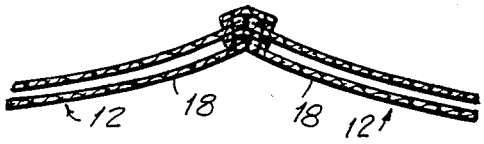
FIG. 21 is a cross-sectional view of the brassiere taken along section line 2I—21 of FIG. 19.

In other alternative embodiments, shown in FIGS. 10 to 11B, the bra cup 12 is open along a side edge. It is to be understood that side edge is to be construed in the broadest possible sense of the word. The cups 12 of the present invention can be open along any side edge, including along center seam 22.

In a still further alternative embodiment shown in FIGS. 12–16, fold-over section 18 may be opened part of the way along armpit edge finishing 34. In this embodiment, fold-over section 18 and lowermost section 16 may be shaped slightly differently than in the embodiments discussed. Fold-over section 18 may be substantially trapezoidal and lowermost section 16 may be substantially triangular. In this embodiment, fold-over section 18 is joined to lowermost section 16 along mid cup seam 32. The two cups 12 are then joined to each other along a center seam 22 which takes in material only from fold-over section 18 and uppermost section 14. Center seam 22 takes in material only along about the lower two-thirds of fold-over section 18 along the center line. A portion of the material of fold-over section 18 along the center point 40. This embodiment of the invention is especially useful for holding a prosthetic device, as shown in FIG. 13, extra padding for "bust enhancement", or other similar device.

In even further, alternative, embodiments, shown in FIG. 17 to 23, lowermost section 16 of bra cup 12 is substantially rectangular, fold-over section 18 is substantially quadrilateral and uppermost section 14 is also substantially quadrilateral. In this embodiment, the lower edge of the uppermost section 14 is joined to the upper edge of fold-over section 18 along the entire length of mid-cup seam 32. The two cups 10 are joined to each other along center seam 22, which takes in material only from uppermost section 14 and fold-over section 18. The lowermost sections 16 of both cups 12 are joined to each other along center seam 22*a*, which takes in material only from lowermost sections 16. The two parts of the cup 12 are then tacked to each other at at least one center point 40*a*. In use as a nursing bra, fold-over section 18 is lifted up and over the breast so as to expose a nipple.

In an even further alternative embodiment (not shown), the cup is constructed in a manner similar to the construction shown in FIGS. 1–6, but the sections of the bra cup 12 do not extend all the way to the armpit edge finishing 34. A connecting band 36 then extends upward, in a similar fashion to the connecting band shown in FIG. 17, and takes in material from all three sections of the cup 12.

Molded cups are also considered to be within the scope of the invention. A molded section can be used in place of a fold-over section and a lowermost section or, alternatively, in place of an uppermost section and a fold-over section. Other possibilities are also contemplated.

Although the style of the cups 12 of brassieres 10 have been described in terms of certain specific embodiments and shapes of the sections, it is to be understood that any bra cup having a fold-over section which does not employ any fastening means is considered to be within the scope of this invention. Fastening means include hooks, snaps, zippers, Velcro fasteners, buttons, or any other device used for the purpose of fastening one piece of material to another As can be seen from the above discussion, bra cups constructed in accordance with the present invention have inner and outer panels defined by the sections. The fold-over section and the section to which it is connected define an outer panel; the section which is not connected to the fold-over section defined an inner panel.

For example, in the embodiment of FIGS. 1–6, the fold-over section and lowermost section define an outer panel; the uppermost section defines an inner panel. Alternatively, in the embodiment of FIGS. 17–23, the fold-over section and the uppermost section define an outer panel; the lowermost section defines an inner panel.

The outer panel is considered to be a "flap". The term "flap" is to be construed in the broadest sense possible and includes any open-sided member of a bra cup. In the case of a molded cup, the section which "folds-over", as defined above, is considered to be an outer flap.

The remainder of the brassiere 10 consists of two connecting bands 36 and fastening means 30. Shoulder straps 20 and an underbust band 26 are optionally provided.

Connecting bands 36 are attached to the outside edge of each bra cup 12 along side seams 24 at both sides of the brassiere 10. Connecting bands 36 may be formed of cotton or any suitable material. Connecting bands 36 are preferably stretchable in both the horizontal and the diagonal directions.

Fastening means 30 are disposed along the edge of connecting bands 36 on the side furthest from side seam 24. The fastening means are employed in order to connect cooperating bands 36 to each other, preferably at the center back. Fastening means 30 may be any suitable arrangement, but conventional hook and eye cooperating elements are most commonly employed. It is preferable to include several sets of eyes so that the brassiere can be easily adjusted to accommodate differently sized girths and be especially useful as a maternity brassiere.

Shoulder straps 20 are optionally connected to the top end of the uppermost section of the bra cup 14 at the shoulder strap connection 38. The straps 20 are connected at their lower end to connecting bands 36. In one embodiment, straps 20 are connected to the uppermost section of bra cup 14 at shoulder strap connection 38 by means of stitching. The lower connection to connecting band 36 may be by any suitable means, such as by stitching or by a connector or by a ring member 46. In this embodiment, a portion of connecting band 36 extends through the ring member 46 and is joined to itself on the opposite side.

Shoulder straps 20 may be any suitable material and is, most preferably, formed of elastic which is stretchable in a vertical direction only. The elastic may then be adapted to move through a strap adjusting means 28 in order to change the length of the strap 20. In a preferred embodiment, strap adjusting means 28 is an adjustable buckle.

Underbust band 26 extends along the entire lower edge of the brassiere 10. It is stitched along the lower edge of lowermost section 16 of each bra cup and along connecting bands 36 at the bottom portion. Underbust band 26 itself is stretchable primarily only in a horizontal direction or transversely of the user's body and provides support for the breasts or weighted prosthesis. In one embodiment, the underbust band 26 is stitched to the brassiere 10 using a zigzag stitch so as to allow the underbust band 26 and the material to which it is stitched, either the lowermost section of the bra cup 16 or connecting bands 36, to stretch in a horizontal direction. Stretch of bra cups 12 and connecting bands 36 is limited in the vertical and diagonal directions by underbust band 26.

As has been mentioned, the various sections of the brassiere of the present invention may be formed of any suitable material. The materials which may be used is not intended to be limited in any way. Examples of suitable materials include cotton, polyester, Lycra Spandex TM, combinations of cotton, polyester and Lycra Spandex TM, nylon, and any other fabric having appropriate resiliency and flexibility.

Although the present invention has been described in some detail by way of illustration and example for purposes of clarity of understanding, it will, of course, be understood that various changes and modifications may be made in the form, details, and arrangements of the parts without departing from the scope of the invention. Exemplary of such other changes and modifications include, but are not limited to, bra cups constructed with wire, garments having the bra cups of the present invention which are constructed as all-in-one body briefers, as long-line brassieres or as strapless brassieres, and brassieres with at least partially, as well as completely, molded cups. The scope of the invention is intended to be defined as set forth in the appended claims.

What is claimed is:

1. A nursing brassiere having openable breast cups connected to side panels and having shoulder strap means, comprising: a plurality of panels forming each of said breast cups; and each said breast cup having at least one bust panel section, and a fold-over panel; said fold-over panel at least partially overlying said bust panel section; said fold-over panels being joined to each other between said breast cups, and to said brassiere along seam lines, and being free of any fastener and at least a portion of said fold-over panel being unattached to any other panel sections so as to enable said fold-over panel to be stretched or deformed along the unattached edge, using one hand to open said breast cup and expose a breast; whereby upon a breast cup being opened, said cup is maintained in the open position by the exposed breast.

2. A brassiere as claimed in claim 1, wherein said cups comprise an underbust panel section and an upperbust panel section, and wherein said fold-over panel is connected to one of said bust panel sections, so as to provide an edge forming part of said fold-over panel which is not attached to said bust panel section.

3. A brassiere as claimed in claim 2, wherein said side panels include fastening means for connecting said side panels to each other.

4. A brassiere as claimed in claim 3, wherein an underbust band is secured along a lower edge of said breast cups and said connecting side panels.

5. A brassiere as claimed in claim 4, wherein each of said breast cups has an underbust panel section; an upperbust panel section, and a fold-over panel.

6. A brassiere as claimed in claim 5, wherein said underbust band is secured to said underbust panels and to said side panels.

7. A brassiere as claimed in claim 2, wherein said shoulder straps include means for adjusting the length of said shoulder straps.

8. A brassiere as claimed in claim 1, wherein said fold-over panel is made of a material which is stretchable in at least one direction.

9. A brassiere as claimed in claim 1, wherein said fold-over panel is stretchable a maximum along the diagonal.

10. A brassiere as claimed in claim 1, wherein said bust panels are made of a material which is stretchable in all directions.

11. A brassiere as defined in claim 2 wherein said fold-over panel section is unattached along a lower edge.

12. A brassiere as defined in claim 2 wherein said fold-over panel section is unattached along an upper edge.

13. A brassiere as defined in claim 2 wherein said fold-over panel section is unattached along a side edge.

14. A brassiere as defined in claim 2 wherein the lower edge of said uppermost panel section is attached to the upper edge of said fold-over panel section along a mid-cup seam and said fold-over panel section is open along its lower edge.

15. A brassiere as defined in claim 14, wherein said breast cups are joined to each other along a center seam which takes in material from both said upper bust panel sections and said fold-over panels and at a second center seam which takes in material only from said underbust panel sections and wherein said two center seams are tacked to each other at a single point.

16. A brassiere as defined in claim 15, wherein said underbust panel section is substantially rectangular in shape, and said fold-over and said upper bust panel sections are both substantially quadrilateral in shape.

17. A brassiere as defined in claim 2, wherein the upper edge of said underbust panel section is attached to the lower edge of said fold-over section along a mid-cup seam and said fold-over panel section is open along the upper edge of the fold-over panel section.

18. A brassiere as defined in claim 14, wherein said breast cups are joined to each other along a center seam which takes in material from both said upperbust panel sections and said underbust panel sections and at a center point which takes in material only from said fold-over panels.

19. A brassiere as defined in claim 18, wherein said upperbust panel is substantially pentagonal in shape, said fold-over section is substantially quadrilateral in shape, and said upperbust panel section is substantially hexagonal in shape.

* * * * *